US008637445B2

(12) United States Patent
Chen et al.

(10) Patent No.: US 8,637,445 B2
(45) Date of Patent: Jan. 28, 2014

(54) FABRIC TREATMENT COMPOSITIONS COMPRISING TARGETED BENEFIT AGENTS

(75) Inventors: Honggang Chen, Shanghai (CN); Paul Ferguson, Wirral (GB); Christopher Clarkson Jones, Wirral (GB); David Richard Arthur Mealing, Wirral (GB); Xiaoyun Pan, Shanghai (CN); Jinfang Wang, Shanghai (CN)

(73) Assignee: Conopco Inc., Englewood Cliffs, NJ (US)

( * ) Notice: Subject to any disclaimer, the term of this patent is extended or adjusted under 35 U.S.C. 154(b) by 0 days.

(21) Appl. No.: 13/816,272

(22) PCT Filed: Aug. 16, 2011

(86) PCT No.: PCT/EP2011/064071

§ 371 (c)(1),
(2), (4) Date: Mar. 18, 2013

(87) PCT Pub. No.: WO2012/022736

PCT Pub. Date: Feb. 23, 2012

(65) Prior Publication Data

US 2013/0184194 A1 Jul. 18, 2013

(30) Foreign Application Priority Data

Aug. 18, 2010 (WO) ..... PCT/CN2010/076087

(51) Int. Cl.
*C11D 3/50* (2006.01)

(52) U.S. Cl.
USPC ..... 512/4; 510/438

(58) Field of Classification Search
USPC ..... 510/438; 512/4
See application file for complete search history.

(56) References Cited

U.S. PATENT DOCUMENTS

| | | | | |
|---|---|---|---|---|
| 2,373,863 A | | 4/1945 | Vitalis | |
| 2,994,665 A | | 8/1961 | Reich | |
| 3,523,088 A | | 8/1970 | Dean | |
| 4,174,305 A | | 11/1979 | Burns | |
| 4,464,271 A | * | 8/1984 | Munteanu et al. | 510/515 |
| 4,732,639 A | | 3/1988 | Newsom | |
| 4,973,417 A | | 11/1990 | Falholt | |
| 5,760,154 A | * | 6/1998 | Krause et al. | 527/311 |
| 6,191,093 B1 | | 2/2001 | Watson | |
| 6,200,351 B1 | | 3/2001 | Schleinig | |
| 6,440,169 B1 | | 8/2002 | Elberg | |
| 2005/0276831 A1 | * | 12/2005 | Dihora et al. | 424/401 |

FOREIGN PATENT DOCUMENTS

| | | | |
|---|---|---|---|
| CA | 2344406 | | 3/2000 |
| DE | 1054638 | | 4/1959 |
| DE | 19942581 | A1 | 3/2000 |
| EP | 0298222 | A2 | 1/1989 |
| EP | 936224 | A1 * | 8/1999 |
| GB | 340232 | | 12/1930 |
| GB | 765811 | | 1/1957 |
| GB | 870081 | | 6/1961 |
| GB | 927542 | | 5/1963 |
| GB | 1084061 | | 9/1967 |
| GB | 1314897 | | 4/1973 |
| WO | WO0215849 | A2 | 2/2002 |
| WO | WO2004056890 | A1 | 7/2004 |
| WO | WO2007012981 | A2 | 2/2007 |
| WO | WO2007062833 | A1 | 6/2007 |
| WO | WO2008005693 | A2 | 1/2008 |

OTHER PUBLICATIONS

PCT International Search Report in PCT application PCT/EP2011064071 dated Nov. 7, 2011 with Written Opinion.

* cited by examiner

*Primary Examiner* — John Hardee
(74) *Attorney, Agent, or Firm* — Rimma Mitelman

(57) ABSTRACT

The invention provides a benefit agent delivery particle comprising hydroxylpropyl cellulose. The benefit agent delivery particle may further comprise a non-polysaccharide polymer, preferably an aminoplast polymer. The benefit agent delivery particle may comprise a perfume. The invention also provides a process for the manufacture of the particles in which perfume oil is encapsulated using emulsion polymerization to form core-shell particles, (in the alternative the perfume may be adsorbed later) and, a further polymer layer is formed on the outer surface of the core shell-particles in the presence of the delivery aid.

8 Claims, No Drawings

FABRIC TREATMENT COMPOSITIONS COMPRISING TARGETED BENEFIT AGENTS

TECHNICAL FIELD

The present invention relates to fabric treatment compositions and, more specifically, to compositions comprising particles which comprise a benefit agent (preferentially perfume) and the deposition aid. The invention also relates to delivery of the benefit agent (preferably perfume) to fabric during laundering.

BACKGROUND OF THE INVENTION

The present invention will be described with particular reference to perfume although the technology is believed applicable to other benefit agents used in fabric treatment processes.

In laundry applications deposition of a perfume is used, for example, during fabric treatment processes such as fabric washing and conditioning. Methods of deposition are diverse and include deposition during the wash or rinse stages of the laundry process or direct deposition before or after the wash, such as by spraying or rubbing or by use of impregnated sheets during tumble drying or water additives during steam ironing. The perfume is often incorporated into a carrier or delivery system. Carrier systems for perfumes are typically based on encapsulation or entrapment of the perfume within a matrix. After deposition onto a surface, a problem exists in that longevity of adherence to that surface of the perfume, in a surfactant containing environment, is inherently poor. A perfume which has been deposited onto a fabric may be washed off again during a main wash, or the perfume may be leached from its carrier into the wash. Protection of the perfume is, therefore, required before and after it has been deposited onto a surface. Much the same problems are encountered with other benefit agents, which are, like perfume typically relatively expensive and present in laundry compositions at relatively low levels.

WO 07/62833 relates to compositions which comprise core-shell encapsulated perfume particles decorated with a polysaccharide which is substantive to cellulose. Preferred polysaccharides disclosed therein are locust bean gum, tamarind xyloglucan, guar gum or mixtures thereof. Thus it is known to have particles comprising a benefit agent (perfume) which use cellulose-substantive polysaccharide as a delivery aid to assist the particles in binding to a specific substrate. The compositions may also comprise one or more enzymes. Suitable enzymes disclosed in the reference include, amongst others, those known as cellulase.

The term cellulase refers to a class of enzymes which show a range of possible reactions on a variety of substrates. One problem with cellulose-substantive polysaccharides is that they have a structure which is generally similar to cellulose, and as such, are subject to attack by "cellulase".

Similar benefit agent delivery aids have been suggested for polyester, based on phthalate containing polymers similar to so-called soil release polymers. These phthalate polymers are subject to problems of hydrolysis and are not substantive to cotton.

A number of documents disclose that cellulosic materials can also function as soil release polymers and anti-redeposition agents. The use of methyl and ethyl cellulose ethers in detergent compositions is disclosed in U.S. Pat. No. 2,373,863, Vitalis (1945). A great many cellulosics for use in detergents are disclosed in U.S. Pat. No. 2,994,665, Reich, et al. (1961); see also U.S. Pat. No. 3,523,088, Dean, et al. (1970).

German Auslegeschrift No. 1,054,638, Van der Werth, Nov. 2, 1956, discloses C12 alkyl benzene sulfonates in combination with carboxylated cellulose derivatives. British Patent No. 1,084,061 discloses low amounts of cellulosics as stabilizers for liquid detergents. British Patent Nos. 927,542; 765,811; and 340,232 also teach cellulosics in detergents.

U.S. Pat. No. 4,174,305 discloses alkyl benzene sulfonate detergent compositions containing cellulose ether soil release agents. U.S. Pat. No. 4,732,639 discloses that some alkyl or alkyl/hydroxy-alkyl cellulose derivatives (with a molar degree of substitution of up to 3.0) are effective as soil release polymers and/or as anti-redeposition polymers. UK 1314897 discloses that hydroxy-propyl methyl cellulose for use as an anti-redeposition and soil release aid, but from that document (as observed in U.S. Pat. No. 6,191,093) it can be seen that performance is somewhat unsatisfactory on pure cotton articles. U.S. Pat. No. 6,200,351 discloses nonionic hydroxyalkyl cellulose ethers suitable for use as soil release polymers in combination with polyester soil release polymers, which include in particular hydroxy-ethyl, hydroxy-propyl and/or hydroxy-butyl celluloses which may additionally carry alkyl ether groups, more particularly, methyl, ethyl and/or propyl groups.

A need exists for a deposition system which is effective both on cotton and polyester.

BRIEF DESCRIPTION OF THE INVENTION

We have now determined that particles comprising a benefit agent which use hydroxypropyl cellulose as a delivery aid are effective both on cotton and on polyester.

Accordingly, a first aspect of the present invention provides a benefit agent delivery particle having at the outer surface of the particle one or more delivery aids which are polysaccharides and include hydroxypropyl cellulose with a molecular weight in excess of 40 kD.

It is preferable that the delivery aid consists essentially of hydroxypropyl cellulose.

The deposition benefit obtained is surprising as when hydroxypropyl cellulose (HPC) is not attached to a particle it does not show particularly good deposition on cotton. It is also notable that without the attachment of the HPC the affinity of the particle for cotton may also be very low. However the combination of the HPC and the particle gives excellent deposition on polyester, cotton and blends thereof.

It is envisaged that a further benefit of the benefit agent delivery particles of the present invention is that they will also give some soil release benefits due to the enhanced affinity to cotton which the delivery aid gains by it's attachment to a particle.

Advantageously, the delivery aid is not susceptible to hydrolysis and is not attacked by the enzymes that are typically used in laundry compositions. In a preferred embodiment the compositions of the invention comprise at least one enzyme with a polysaccharide substrate. Preferably this is selected from hemicellulase, cellulase (which is particularly preferred), polygalacturonase, xylanase, pectinase, mannanase (which is also particularly preferred), pectate lyase, lignin-ase, pullulanase, pentosanase, arabinosidase, hyaluronidase, chondroitinase, laccase, glycosylhydrolase, and amylases, or mixtures thereof. The stability of the delivery aid in the presence of these common enzymes, particularly cellulase, gives a significant advantage over the previously known deposition systems based on Locust Bean Gum.

In another preferred embodiment the compositions of the invention contain polyesterase. Both polyesterase and the polysaccharide-substrate enzymes can be present.

Preferably the benefit agent delivery particle comprises a polymer other than the polysaccharide.

Preferably the benefit agent delivery particle comprises a perfume.

Preferably the benefit agent delivery particle comprises a core and at least one shell. In particularly preferred embodiments perfume is present in the core and the delivery aid is attached to the outside of the outermost shell. While it is preferred that the delivery aid is attached directly to the shell it may be attached via a linking species. By attachment is meant that the delivery aid is not removed in water, thus the delivery aid is a permanent part of the particle and not a water-soluble coating.

In a particularly preferred embodiment the invention provides a liquid laundry treatment composition comprising at least one anionic or non-ionic surfactant, an enzyme selected from cellulase, mannanase and mixtures thereof and polymeric core-shell particles comprising perfume, characterised in that, hydroxypropyl cellulose is attached to the outside of the shell of the particles as a delivery aid.

DETAILED DESCRIPTION OF THE INVENTION

In order that the present invention may be further understood it is described in further detail below with particular reference to preferred features. Where percentages are given they are, unless described otherwise percentages by weight. Similarly, all ratios are ratio's by weight unless otherwise specified.

Where chemical structures of polymers are given they are given in a generalised form showing the substituent groups which are present but not depicting the actual distribution of the substituent groups, or the degree of substitution.

Delivery Aid:

Hydroxypropyl Cellulose (HPC) has the repeat structure shown in generalised terms below:

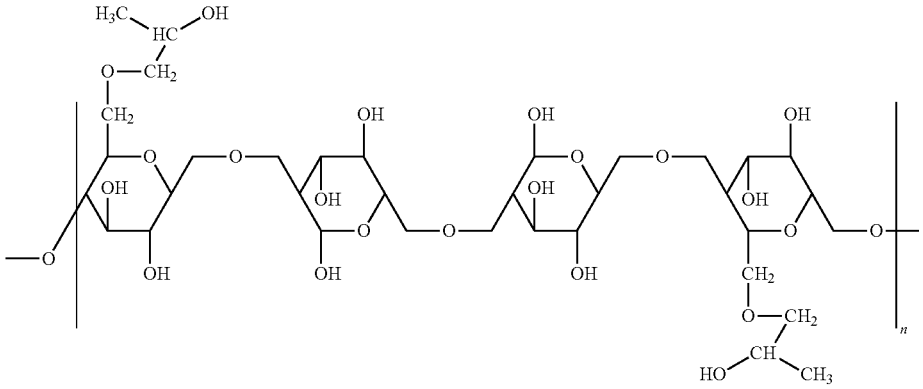

Especially good results were obtained when the HPC was one which had a viscosity in 2% wt aqueous solution of 1000-4000 mPa·s. HPC viscosity measurements are done using a Brookfield viscometer, Spindle #3, @30 rpm. Their lower viscosity materials are measured using Spindle #2, @60 rpm.

HPC is an ether of cellulose in which some of the hydroxyl groups in the repeating glucose units have been hydroxypropylated forming —OCH2CH(OH)CH3 groups using propylene oxide. The average number of substituted hydroxyl groups per glucose unit is referred to as the degree of substitution (DS). Complete substitution would provide a DS of 3. However, as the hydroxy-propyl group itself contains a hydroxyl group, this can also be etherified during preparation of HPC. When this occurs, the number of moles of hydroxypropyl groups per glucose ring, moles of substitution (MS), can be higher than 3.

Preferably the HPC has a molecular weight above 50 kD and more preferably above 140 kD, most preferably above 500 kD. The majority (typically around 75% for a DS of 3) of the mass of HPC is found in the substituent groups rather than the backbone.

DS is typically in the range from 1.0 to 3, more preferably above 1.5 to 3, most preferably from 2.0 to 3.0.

A typical MS for the HPC is 1.5-6.5. Preferably the MS is in the range from 2.8 to 4.0, more preferably above 3.0, most preferably from 3.2 to 3.8.

A particularly preferred HPC has Mw 910 kD and MS 3.5.

As will be seen from the examples as appended hereto, as the molecular weight is reduced the performance of the HPC as a deposition aid decreases.

Benefit Agents

Benefit agents provide a range of benefits to cloth. These include benefits of softening, conditioning, lubricating, crease reducing, ease of ironing, moisturising, colour preserving and/or anti-pilling, quick drying, UV protecting, shape retaining, soil releasing, texturising, insect repelling, fungicidal, dyeing and/or fluorescent benefit to the fabric.

A highly preferred benefit is the delivery of fragrance.

Preferred benefit agents are perfumes (whether free and/or encapsulated), pro-fragrance, clays, enzymes, antifoams, fluorescers, bleaching agents and precursors thereof (including photo-bleach), shading dyes and/or pigments, fabric conditioning agents (for example cationic surfactants including water-insoluble quaternary ammonium materials and/or silicones), lubricants (e.g. sugar polyesters), photo-protective agents (including sunscreens), antioxidants, reducing agents, sequestrants, colour care additives (including dye fixing agents), unsaturated oil, emollients, insect repellents and/or pheromones, drape modifiers (e.g. polymer latex particles such as PVAc) and anti-microbial and microbe control agents. Mixtures of two or more of these may be employed. Particular benefit agents are described in further detail below.

Benefit Agent Association and Carriers

The delivery aid is attached to a particle which either comprises the benefit agent per-se or which is itself a carrier for the benefit agent. An example of such would be a perfume carrying particle with the delivery aid attached to the surface of the particle.

While it is preferred to use polymer particles, preferably core-shell encapsulates, many other types of particle can be envisaged as the benefit agent carrier. Perfumes have been adsorbed onto a clay or zeolite material that is then admixed into particulate detergent compositions: U.S. Pat. No. 4,539,135 discloses particulate laundry compounds comprising a clay or zeolite material carrying perfume. Combinations of perfumes generally with larger pore size zeolites such as zeolite X and Y are also taught in the art. East German Patent Publication No. 248,508, relates to perfume dispensers containing a faujasite-type zeolite (e.g., zeolite X and Y) loaded with perfume. Also, East German Patent Publication No. 137,599, published Sep. 12, 1979 teaches compositions for use in powdered washing agents to provide thermo-regulated release of perfume. Zeolites A, X and Y are taught for use in these compositions. Other perfume delivery systems are taught by WO 97/34982 and WO 98/41607, published by The Procter & Gamble. WO 97/34982 discloses particles comprising perfume loaded zeolite and a release barrier, which is an agent derived from a wax and having a size (i.e., a cross-sectional area) larger than the size of the pore openings of the zeolite carrier. WO 98/41607 discloses glassy particles comprising agents useful for laundry or cleaning compositions and a glass derived from one or more of at least partially-water-soluble hydroxylic compounds.

Silicas, amorphous silicates, crystalline nonlayer silicates, layer silicates, calcium carbonates, calcium/sodium carbonate double salts, sodium carbonates, sodalites, alkali metal phosphates, pectin, chitin microbeads, carboxyalkylcelluloses, gums, resins, gelatin, gum arabic, porous starches, modified starches, carboxyalkyl starches, cyclodextrins, maltodextrins, synthetic polymers such as polyvinyl pyrrolidone (PVP), polyvinyl alcohol (PVA), cellulose ethers, polystyrene, polyacrylates, polymethacrylates, polyolefins, aminoplast polymers, crosslinkers and mixtures thereof can all provide a basis for perfume particles. Polymer particles are however preferred, especially polymer particles which comprise an aminoplast polymer.

The benefit agent carrying particles are typically of a size between 100 nanometers and 50 microns. Particles larger than this are entering the visible range.

The preferred particle size range is either in the sub-micron range or the micron range.

Suitable particles in the sub-micron range include nanoparticles, latexes, and mini-emulsion products with a typical size range of 100-600 nanometers.

Suitable particles in the micron range include known types of melamine/urea-formaldehyde encapsulates, silica, clays starch and zeolite particles and coacervates with a typical size range of 1-50 microns, preferably 5-30 microns.

In one preferred aspect of the invention the HPC, as deposition aid, is attached to at least partially pre-formed particles.

The delivery aid is bound to the particle by means of a covalent bond, entanglement or strong adsorption, preferably by a covalent bond or entanglement and most preferably by means of a covalent bond. By entanglement as used herein is meant that the delivery aid is adsorbed onto the particle as the polymerisation proceeds and the particle grows in size. It is believed that under such circumstances part of the adsorbed delivery aid becomes buried within the interior of the particle. Hence at the end of the polymerisation, part of the delivery aid is entrapped and bound in the polymer matrix of the particle, whilst the remainder is free to extend into the aqueous phase.

The delivery is preferably mainly attached to the particle surface and is not, to any significant extent, distributed throughout the internal bulk of the particle. Thus the particle which is produced when using a delivery aid according to the preferred process of the invention can be thought of as a "hairy particle" (with relatively stiff hairs).

The polymer carrier particles of the invention can comprise a wide selection of monomer units. By "monomer units" as used herein is meant the monomer units of the polymer chain, thus references to "a polymer particle comprising insoluble monomer units" as used herein means that the polymer particles is derived from insoluble monomers, and so forth.

As noted above, the monomer units are preferably derived from monomers which are suitable for either step growth polymerisation or addition/free radical polymerisation.

Where the particle itself is not the benefit agent, the benefit agent is typically present in an amount of from 10-85% by total weight of the carrier particle, preferably from 20 to 75% by total weight of the particle.

Perfume as the Benefit Agent

The perfume suitably has a molecular weight of from 50 to 500. Where pro-fragrances are used the molecular weight will generally be higher.

Useful components of the perfume include materials of both natural and synthetic origin. They include single compounds and mixtures. Specific examples of such components may be found in the current literature, e.g., in Fenaroli's Handbook of Flavour Ingredients, 1975, CRC Press; Synthetic Food Adjuncts, 1947 by M. B. Jacobs, edited by Van Nostrand; or Perfume and Flavour Chemicals by S. Arctander 1969, Montclair, N.J. (USA). These substances are well known to the person skilled in the art of perfuming, flavouring, and/or aromatizing consumer products, i.e., of imparting an odour and/or a flavour or taste to a consumer product traditionally perfumed or flavoured, or of modifying the odour and/or taste of said consumer product.

By perfume in this context is not only meant a fully formulated product fragrance, but also selected components of that fragrance, particularly those which are prone to loss, such as the so-called 'top notes'. The perfume component could also be in the form of a pro-fragrance. WO 2002/038120 (P&G), for example, relates to photo-labile pro-fragrance conjugates which upon exposure to electromagnetic radiation are capable of releasing a fragrant species.

Top notes are defined by Poucher (Journal of the Society of Cosmetic Chemists 6(2):80 [1955]). Examples of well known top-notes include citrus oils, linalool, linalyl acetate, lavender, dihydromyrcenol, rose oxide and cis-3-hexanol. Top notes typically comprise 15-25% wt of a perfume composition and in those embodiments of the invention which contain an increased level of top-notes it is envisaged at that least 20% wt would be present within the encapsulate.

Typical perfume components which it is advantageous to encapsulate, include those with a relatively low boiling point, preferably those with a boiling point of less than 300, preferably 100-250 Celsius.

It is also advantageous to encapsulate perfume components which have a low LogP (ie. those which will be partitioned into water), preferably with a LogP of less than 3.0. These materials, of relatively low boiling point and relatively low LogP have been called the "delayed blooming" perfume ingredients and include the following materials:

Allyl Caproate, Amyl Acetate, Amyl Propionate, Anisic Aldehyde, Anisole, Benzaldehyde, Benzyl Acetate, Benzyl Acetone, Benzyl Alcohol, Benzyl Formate, Benzyl Iso Valerate, Benzyl Propionate, Beta Gamma Hexenol, Camphor Gum, Laevo-Carvone, d-Carvone, Cinnamic Alcohol, Cinamyl Formate, Cis-Jasmone, cis-3-Hexenyl Acetate, Cuminic Alcohol, Cyclal C, Dimethyl Benzyl Carbinol, Dimethyl Benzyl Carbinol Acetate, Ethyl Acetate, Ethyl Aceto Acetate, Ethyl Amyl Ketone, Ethyl Benzoate, Ethyl Butyrate, Ethyl Hexyl Ketone, Ethyl Phenyl Acetate, Eucalyptol, Eugenol, Fenchyl Acetate, Flor Acetate (tricyclo Decenyl Acetate), Frutene (tricycico Decenyl Propionate), Geraniol, Hexenol, Hexenyl Acetate, Hexyl Acetate, Hexyl Formate, Hydratropic Alcohol, Hydroxycitronellal, Indone, Isoamyl Alcohol, Iso Menthone, Isopulegyl Acetate, Isoquinolone, Ligustral, Linalool, Linalool Oxide, Linalyl Formate, Menthone, Menthyl Acetphenone, Methyl Amyl Ketone, Methyl Anthranilate, Methyl Benzoate, Methyl Benzyl Acetate, Methyl Eugenol, Methyl Heptenone, Methyl Heptine Carbonate, Methyl Heptyl Ketone, Methyl Hexyl Ketone, Methyl Phenyl Carbinyl Acetate, Methyl Salicylate, Methyl-N-Methyl Anthranilate, Nerol, Octalactone, Octyl Alcohol, p-Cresol, p-Cresol Methyl Ether, p-Methoxy Acetophenone, p-Methyl Acetophenone, Phenoxy Ethanol, Phenyl Acetaldehyde, Phenyl Ethyl Acetate, Phenyl Ethyl Alcohol, Phenyl Ethyl Dimethyl Carbinol, Prenyl Acetate, Propyl Bornate, Pulegone, Rose Oxide, Safrole, 4-Terpinenol, Alpha-Terpinenol, and/or Viridine It is commonplace for a plurality of perfume components to be present in a formulation. In the encapsulates of the present invention it is envisaged that there will be four or more, preferably five or more, more preferably six or more or even seven or more different perfume components from the list given of delayed blooming perfumes given above present in the encapsulated perfume.

Part or all of the perfume may be in the form of a pro-fragrance. For the purposes of the present invention a pro-fragrance is any material which comprises a fragrance precursor that can be converted into a fragrance.

Suitable pro-fragrances are those that generate perfume components which are aldehydes. Aldehydes useful in perfumery include but are not limited to phenylacetaldehyde, p-methyl phenylacetaldehyde, p-isopropyl phenylacetaldehyde, methylnonyl acetaldehyde, phenylpropanal, 3-(4-t-butylphenyl)-2-methyl propanal, 3-(4-t-butylphenyl)-propanal, 3-(4-methoxyphenyl)-2-methylpropanal, 3-(4-isopropylphenyl)-2-methylpropanal, 3-(3,4-methylenedioxyphenyl)-2-methyl propanal, 3-(4-ethylphenyl)-2,2-dimethylpropanal, phenylbutanal, 3-methyl-5-phenylpentanal, hexanal, trans-2-hexenal, cis-hex-3-enal, heptanal, cis-4-heptenal, 2-ethyl-2-heptenal, 2,6-dimethyl-5-heptenal, 2,4-heptadienal, octanal, 2-octenal, 3,7-dimethyloctanal, 3,7-dimethyl-2,6-octadien-1-al, 3,7-dimethyl-1,6-octadien-3-al, 3,7-dimethyl-6-octenal, 3,7-dimethyl-7-hydroxyoctan-1-al, nonanal, 6-nonenal, 2,4-nonadienal, 2,6-nonadienal, decanal, 2-methyl decanal, 4-decenal, 9-decenal, 2,4-decadienal, undecanal, 2-methyl-decanal, 2-methylundecanal, 2,6,10-trimethyl-9-undecenal, undec-10-enyl aldehyde, undec-8-enanal, dodecanal, tridecanal, tetradecanal, anisaldehyde, bourgenonal, cinnamic aldehyde, a-amylcinnam-aldehyde, a-hexyl cinnamaldehyde, methoxy-cinnamaldehyde, citronellal, hydroxy-citronellal, isocyclocitral, citronellyl oxyacet-aldehyde, cortexaldehyde, cumminic aldehyde, cyclamen aldehyde, florhydral, heliotropin, hydrotropic aldehyde, lilial, vanillin, ethyl vanillin, benzaldehyde, p-methyl benzaldehyde, 3,4-dimethoxybenzaldehyde, 3- and 4-(4-hydroxy-4-methyl-pentyl)-3-cyclohexene-1-carboxaldehyde, 2,4-dimethyl-3-cyclohexene-1-carboxaldehyde, 1-methyl-3-(4-methylpentyl)-3-cyclohexen-carboxaldehyde, p-methylphenoxyacetaldehyde, and mixtures thereof.

Another group of perfumes with which the present invention can be applied are the so-called 'aromatherapy' materials. These include many components also used in perfumery, including components of essential oils such as Clary Sage, Eucalyptus, Geranium, Lavender, Mace Extract, Neroli, Nutmeg, Spearmint, Sweet Violet Leaf and Valerian. By means of the present invention these materials can be transferred to textile articles that will be worn or otherwise come into contact with the human body (such as handkerchiefs and bed-linen).

The perfume may be encapsulated alone or co-encapsulated with carrier materials, further deposition aids and/or fixatives. Preferred materials to be co-encapsulated in carrier particles with the perfume include waxes, paraffins, stabilizers and fixatives.

An optional yet preferred component of carrier particles is a formaldehyde scavenger. This is particularly advantageous in carrier particles which may comprise formaldehyde as a consequence of their manufacturing process or components. formaldehyde scavenger is chosen from: sodium bisulfite, urea, cysteine, cysteamine, lysine, glycine, serine, carnosine, histidine, glutathione, 3,4-diaminobenzoic acid, allantoin, glycouril, anthranilic acid, methyl anthranilate, methyl 4-aminobenzoate, ethyl acetoacetate, acetoacetamide, malonamide, ascorbic acid, 1,3-dihydroxyacetone dimer, biuret, oxamide, benzoguanamine, pyroglutamic acid, pyrogallol, methyl gallate, ethyl gallate, propyl gallate, triethanol amine, succinimide, thiabendazole, benzotriazol, triazole, indoline, sulfanilic acid, oxamide, sorbitol, glucose, cellulose, poly (vinyl alcohol), poly(vinyl amine), hexane diol, ethylenediamine-N,N'-bisacetoacetamide, N-(2-ethylhexyl)acetoacetamide, N-(3-phenylpropyl)acetoacetamide, lilial, helional, melonal, triplal, 5,5-dimethyl-1,3-cyclohexanedione, 2,4-dimethyl-3-cyclohexenecarboxaldehyde, 2,2-dimethyl-1,3-dioxan-4,6-dione, 2-pentanone, dibutyl amine, triethylenetetramine, benzylamine, hydroxycitronellol, cyclohexanone, 2-butanone, pentane dione, dehydroacetic acid, chitosan, or a mixture thereof. Preferred formaldehyde scavengers are sodium bisulfite, ethyl acetoacetate, acetoacetamide, ethylenediamine-N,N'-bisacetoacetamide, ascorbic acid, 2,2-dimethyl-1,3-dioxan-4,6-dione, helional, triplal, lilial and mixtures thereof.

Enzymes

It is preferred that the compositions according to the invention comprise one or more enzymes. When present in a cleaning composition, the aforementioned enzymes may be present at levels from about 0.00001 wt. % to about 2 wt. %, from about 0.0001 wt. % to about 1 wt. % or even from about 0.001 wt. % to about 0.5 wt. % enzyme protein by weight of the composition.

Process Details

The process for the preparation of the particles is preferably a two step process in which the first step forms a particle comprising the benefit agent and the second step applies a coating to the capsule which includes the HPC as a deposition aid.

The first step can either be step-growth or addition polymerisation and the second step is preferably addition polymerisation.

In the alternative a particle can be formed which does not contain the benefit agent but which is capable of adsorbing it at some later time. This particle is then decorated with the deposition aid thereby performing a two-step process analogous to that described above. The particle is subsequently exposed to the benefit agent which diffuses into the particle. Conveniently, this may be done in-product, for example by adding the particles with deposition aid to a partly or fully formulated product which contains the benefit agent. The benefit agent is then adsorbed by the particle and retained within the particle during use of the product, so that at least some of the benefit agent is released from the particles after the fabric treatment process, when the particles have become deposited on the fabric.

Suitable classes of monomers for step-growth polymerization are given in the group consisting of the melamine/urea/formaldehyde class, the isocyanate/diol class (preferably the polyurethanes) and polyesters.

Preferred are the melamine/urea formaldehyde class and the polyurethanes.

Suitable classes of monomers for addition/free radical polymerization are given in the group consisting of olefins, ethylene, vinylaromatic monomers, esters of vinyl alcohol with mono- and di-carboxylic acids, esters of α,β-monoethylenically unsaturated mono- and dicarboxylic acids with alcohols, nitriles of α,β-monoethylenically unsaturated carboxylic acids, conjugated dienes, α,β-monoethylenically unsaturated monocarboxylic and dicarboxylic acids and their amides, methacrylic acid and its esters with alcohols and diols, acrylic acid and its esters with alcohols and diols, dimethyl or di-n-butyl maleate, and vinyl-sulfonic acid and its water-soluble salts, and mixtures thereof. The polymer particle may comprise mixtures of monomer units.

The polymer particle may optionally comprise monomers which are cross-linkers. Such cross-linkers may have at least two non-conjugated ethylenically unsaturated double bonds. Examples are alkylene glycol diacrylates and dimethacrylates. A further type of suitable cross-linking monomers are those that are conjugated, such as divinyl benzene. If present, these monomers constitute from 0.1 to 10% by weight, based on the total amount of monomers to be polymerised.

The monomers are preferably selected from: styrene; α-methylstyrene; o-chlorostyrene; vinyl acetate; vinyl propionate; vinyl n-butyrate; esters of acrylic, methacrylic, maleic, fumaric or itaconic acid with methyl, ethyl, n-butyl, isobutyl, n-hexyl and 2-ethylhexyl alcohol; 1,3-butadiene; 2,3 dimethyl butadiene; and isoprene. The preferred monomers are vinyl acetate and methyl acrylate.

Optionally, the monomers are used as co-monomers with one or more of acrylic acid, methacrylic acid, maleic acid, fumaric acid, itaconic acid, poly (alkylene oxide) monoacrylates and monomethacrylates, N-vinyl-pyrrolidone, methacrylic and acrylic acid, 2-hydroxyethyl acrylates and methacrylates, glycerol acrylates and methacrylates, poly (ethylene glycol) methacrylates and acrylates, n-vinyl pyrrolidone, acryloyl morpholine, vinyl form amide, n-vinyl acetamide and vinyl caprolactone, acrylonitrile (71 g/l), acrylamide, and methacrylamide at levels of less than 10% by weight of the monomer unit content of the particle; 2-(dimethylamino) ethyl methacrylate, 2-(diethylamino) ethyl methacrylate, 2-(tert-butylamino) ethyl methacrylate, 2-aminoethyl methacrylate, 2-(2-oxo-1-imidazolidinyl)ethyl methacrylate, vinyl pyridine, vinyl carbazole, vinyl imidazole, vinyl aniline, and their cationic forms after treatment with alkyl halides.

Optional cross linkers include vinyltoluenes, divinyl benzene, ethylene glycol diacrylate, 1,2-propylene glycol diacrylate, 1,3-propylene glycol diacrylate, 1,3-butylene glycol diacrylate, 1,4-butylene glycol diacrylates, ethylene glycol dimethacrylate, 1,2-propylene glycol dimethacrylate, 1,3-propylene glycol dimethacrylate, 1,3-butylene glycol dimethacrylate, 1,4-butylene glycol dimethacrylate, divinylbenzene, vinyl methacrylate, vinyl acrylate, allyl methacrylate, allyl acrylate, diallyl maleate, diallyl fumarate, methylenebisacrylamide, cyclopentadienyl acrylate, and triallyl cyanurate.

It is preferable that the ratio of the monomers used in the overall shell formation and those used in deposition aid attachment are the ratio of 100:1 to 5:1 (as bulk shell former: deposition linker). Preferably, the ratio is 100:1-50:1.

As noted above the process for the preparation of the particles is preferably a two step process in which the first step forms a capsule around the benefit agent and the second step applies a coating to the capsule which includes the deposition aid. The first step can either be step-growth or addition polymerization and the second step is preferably addition polymerization.

It is particularly preferably that the first step uses monomers selected from melamine/urea-formaldehyde or methylmethacrylate or isocyanate/diol, and the second step uses monomers selected from vinyl acetate and/or methyl acrylate.

It is particularly preferred that the deposition aid is not added until the second step.

For step-growth polymerization some heating is generally necessary to cause polymerization to proceed. Initiators and chain transfer agents may also be present in the polymerization mixture where use is made of any addition polymerization. Those skilled in the art will recognize that a chemical initiator will generally be required for addition polymerization but that there are instances in which alternative forms of initiation will be possible, e.g. ultrasonic initiation or initiation by irradiation.

The initiator is preferably a chemical or chemicals capable of forming free radicals. Typically, free radicals can be formed either by homolytic scission (i.e. homolysis) of a single bond or by single electron transfer to or from an on or molecule (e.g. redox reactions). Suitably, in context of the invention, homolysis may be achieved by the application of heat (typically in the range of from 50 to 100° C.). Some examples of suitable initiators in this class are those possessing peroxide (—O—O—) or azo (—N═N) groups, such as benzoyl peroxide, t-butyl peroxide, hydrogen peroxide, azobisisobutyronitrile and ammonium persulphate. Homolysis may also be achieved by the action of radiation (usually ultraviolet), in which case it is termed photolysis. Examples are the dissociation of 2,2'-azobis (2-cyanopropane) and the formation of free radicals from benzophenone and benzoin. Redox reactions can also be used to generate free radicals. In this case an oxidising agent is paired with a reducing agent which then undergo a redox reaction. Some examples of appropriate pairs in the context of the invention are ammonium persulphate/sodium metabisulphite, cumyl hydroperoxide/ferrous on and hydrogen peroxide/ascorbic acid.

Preferred initiators are selected from the following:

Homolytic: benzoyl peroxide, t-butyl peroxide, hydrogen peroxide, azobisisobutyronitrile, ammonium persulphate, 2,2'-azobis (cyanopropane), benzophenone, benzoin, Redox: ammonium persulphate/sodium metabisulphite mixture, cumyl hydroperoxide/ferrous on mixture and/or hydrogen peroxide/ascorbic acid mixture.

Preferred initiators are ammonium persulphate and hydrogen peroxide/ascorbic acid mixture. The preferred level of initiator is in the range of from 0.1 to 5.0% w/w by weight of monomer, more preferably, the level is in the range of from 1.0 to 3.0% w/w by weight of monomer.

Chain transfer agents can optionally be used. A chain transfer agent contains very labile hydrogen atoms that are easily abstracted by a propagating polymer chain. This terminates the polymerization of the growing polymer, but generates a new reactive site on the chain transfer agent that can then proceed to initiate further polymerization of the remaining monomer. Chain transfer agents in the context of the invention typically contain thiol (mercaptan) functionality and can be represented by the general chemical formula RS—H, such as n-dodecyl mercaptan and 2-mercaptoethanol. Preferred chain transfer agents are monothioglycerol and n-dodecyl mercaptan, used at levels of, preferably from 0 to 5% w/w based on the weight of the monomer and more preferably at a level of 025% w/w based on the weight of the monomer.

The preferred product of such a process is a slurry or dispersion comprising some 30-50% of solids.

Attachment of the deposition aid to the particle can be done by means of, for example, an EDAC coupling. However, a particularly preferred process is one in which:

a) emulsion polymerization is used to form core shell particles, and, b) a further polymer layer is formed on the outer surface of the particles in the presence of hydroxypropyl cellulose.

Preferably the polymer is melamine/formaldehyde.

Laundry Treatment Compositions

The delivery aid linked particles of the invention may be incorporated into laundry compositions. This may be done by mixing a slurry/dispersion product with some or all of the other components of the composition, for powders preferably by spraying onto the components. Advantageously, the slurry/dispersion need not be dried extensively (if at all) and this reduces benefit agent losses.

The particles are typically included in said compositions at levels of from 0.001% to 10%, preferably from 0.005% to 5%, most preferably from 0.01% to 3% by weight of the total composition.

The active ingredient in the compositions is preferably a surface active agent or a fabric conditioning agent. More than one active ingredient may be included. For some applications a mixture of active ingredients may be used.

The compositions of the invention may be in any physical form e.g. a solid such as a powder or granules, a tablet, a solid bar, a paste, gel or liquid, especially, an aqueous based liquid. In particular the compositions may be used in laundry compositions, especially in liquid, powder or tablet laundry composition. Liquids are particularly preferred as the problems of hydrolysis and enzyme attack on the deposition aid are more marked in liquid compositions.

The compositions of the present invention are preferably laundry compositions, especially main wash (fabric washing) compositions or rinse-added softening compositions. The main wash compositions may include a fabric softening agent and the rinse-added fabric softening compositions may include surface-active compounds, particularly non-ionic surface-active compounds.

The detergent compositions of the invention may contain a surface-active compound (surfactant) which may be chosen from soap and non-soap anionic, cationic, non-ionic, amphoteric and zwitterionic surface-active compounds and mixtures thereof. Many suitable surface-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic, and non-ionic compounds.

In order that the present invention may be further understood and carried forth into practice it will be further described with reference to the following examples. In the examples, as in the rest of the specification, all percentages are by weight unless otherwise specified.

EXAMPLES

Hydroxy-propyl cellulose (HPC) powders under trademark H0386, H0473, H0474 and H0475 were supplied by Tokyo Chemical Industry Co., LTD (TCI) and the samples' viscosity in 2% aqueous solution were shown in the following table:

| | viscosity in 2% aqueous solution at 20° C. |
|---|---|
| H0386 | 150-400 mPa · s |
| H0473 | 3-6 mPa · s |
| H0474 | 6-10 mPa · s |
| H0475 | 1000-4000 mPa · s |

Example 1

Deposition Performance of HPCs on Fabrics

The adsorption of HPC samples onto polyester and cotton were measured with LAS and Synperonic™ A7 as surfactant stock. The measurement protocol was described as below:

For test formulation, dodecylbenzenesulphonic acid sodium salt (LAS) was purchased from Aldrich. Synperonic A7, a fatty alcohol ethoxylate, nonionic surfactant (NI) was obtained from Uniqema. Sodium carbonate and potassium carbonate were supplied by Shanghai Lingfeng Chemical Reagent Co., Ltd, and sodium bicarbonate supplied by Shanghai Hongguang Co., Ltd.

a) Preparation of Stock Solutions

Surfactant stock solution was prepared by dissolving LAS (5.000 g) and NI (5.000 g) in de-ionised water to a total of 1.0 liter. The surfactant concentration of final solution is 10.000 g/L (50% LAS, 50% NI). Base buffer stock solution was prepared by dissolving sodium carbonate (7.547 g) and sodium bicarbonate (2.420 g) in de-ionised water to a total of 1.0 liter. The base buffer concentration is 0.1 M. HPC stock solution was prepared by dissolving 0.100 g of HPC in 100 mL of de-ionised water and stirring at 25° C. overnight to obtain polymer concentration 1.0 g/L.

b) Bottle Wash Procedure

The constant temperature shaking apparatus (model THZ platform, supplied by Shanghai Jing Hong laboratory instrument Co. Ltd.) was utilized to simulate wash procedure for deposition performances assessment. The typical procedure was described as below.

A piece of unfluoresced knitted polyester (around 5.0 g with 20×20 cm) or three pieces (10×10 cm) of cotton fabric (totally around 4.7 g) was placed into a 60 mL bottle containing the model wash liquor (1.0 g/L mixed surfactant, 0.01 M base buffer) and HPC sample with different concentration (0.64 g/L, 0.40 g/L or 0.24 g/L) and the bottle sealed. A bottle containing model wash liquor and fabric but no HPC sample was prepared as control. The purpose was to check whether the fabric caused any changes to the absorbance levels on its own. The shaker bath was heated to 40° C. and the bottles clamped into it and shaken at 125 rpm for 45 mins. Wash liquor before/after shaking was taken out for further evaluation.

c) Quantitative Calculation for Deposition

Phenol-sulphuric procedure was utilized for determination of HPC concentration (Dubois, M., Gilles, K. A., Hamilton, J. K., Roberts, P. A. and Smith, F., 1956, Colorimetric method for the determination of sugars and related substances. *Analytical Chemistry* 28, 350-356). A typical procedure was shown as below: 2.0 mL polymer solution was transferred into a 20 mL glass vial. To this solution 1.0 mL of a 5% (w/w) phenol solution in distilled water was added and the solution gently mixed. Then 5.0 mL concentrated sulphuric acid was added drop-wise (Caution: this gives rise to a very exothermic reaction). The solution was allowed to cool for at least 45 minutes before absorbance was measured at 489 nm. The deposition amount of HPC sample onto fabric could be calculated based upon the absorbency difference of HPC in wash liquor before/after deposition evaluation.

d) Deposition Evaluation Results

The deposition results of HPC samples onto polyester and cotton were illustrated in the following table which shows mg/g: mg polymer deposited on per g fabric:

| HPC code | Concentration (g/L) | Amount adsorbed on polyester after main wash (mg/g) | Amount adsorbed on cotton after main wash (mg/g) |
|---|---|---|---|
| H0386 | 0.24 | 4.0 | — |
| H0386 | 0.40 | 2.9 | — |
| H0473 | 0.24 | 1.4 | — |
| H0473 | 0.40 | 2.2 | — |
| H0474 | 0.24 | 3.0 | — |
| H0474 | 0.40 | 2.9 | — |
| H0474 | 0.64 | 0.8 | — |
| H0475 | 0.24 | 2.1 | — |
| H0475 | 0.40 | 4.1 | — |
| H0475 | 0.64 g/L | 0.9 | 2.4 |

These results show that HPC samples showed evident deposition performance on polyester and, in one case only and when used at relatively high levels on cotton.

Example 2

Surface Attachment of HPC onto Latex Particles (600 nm) via EDAC Coupling

1-Ethyl-3-(3-dimethylaminopropyl)carbodiimide hydrogen chloride (EDAC) was obtained from Alfa Aesor and all other chemicals obtained from Sinopharm Chemical Reagent Co., Ltd.

a) Synthesis of Carboxyl Functional Polystyrene Particle (600 Nm)

Carboxyl functional polystyrene particles were synthesized by emulsifier-free emulsion polymerization. 250 mL three-neck flask was charged with 9.230 g styrene, 0.196 g methylacrylate and 90 mL de-ionised water. A nitrogen blanket and stirring rate of 350 rpm were maintained. This solution was deoxygenated by bubbling with nitrogen for 1.0 h. After thorough deoxygenation, the temperature was increased to 70° C. and a solution of 0.089 g potassium persulfate in 3 mL water injected. The mixture was allowed to react at 70° C. for 16 hs. After being allowed to cool down to room temperature, the colloid was filtered and then collected.

b) Purification of Latex Particles

The carboxyl functional polystyrene particle (600 nm, 7.1% solids) was purified via the following procedure: Step 1: 1.0 mL latex was diluted with 0.5 mL pH 9.01 buffer and centrifuged at 10000 rpm for 15 minutes. Step 2: The supernatant was decanted off. The latex was re-dispersed in 1.0 mL of pH 7 buffer. The latex was centrifuged again at 10000 rpm for 15 minutes. The wash in pH7 buffer was repeated once. Step 3: The supernatant decanted off. The latex was re-dispersed in 1.0 mL de-ionised water. The latex was centrifuged at 10000 rpm for 15 minutes and the supernatant decanted off. The wash in de-ionised water was also repeated once.

c) Grafting of H0475 onto Latex Particles (600 nm) Via EDAC Coupling

The purified latex (1.0 mL, 7.1% solids) was re-dispersed in EDAC solution (0.027 g in 1.0 mL of de-ionised water) and stirred at 25° C. for 3 hours. Then the latex was centrifuged at 10000 rpm for 15 minutes and purified in pH 7 buffer and de-ionised water according to Step 2 and 3 shown in Example 2b. Then the latex was re-dispersed in 14 g of 0.1% (w/w) H0475 in de-ionised water solution. The dispersion was stirred at 25° C. for 18 hours. After that, the latex was centrifuged at 10000 rpm for 15 minutes and purified in pH 7 buffer and de-ionised water again according to Step 2 and 3 shown in Example 2b. At last, the latex was re-dispersed in de-ionised water to give a final latex dispersion of HPC grafted particles with solids of 1.0% (w/w).

d) Preparation of Comparative Example (Polystyrene Latex without Surface Attached H0475)

A comparative (control) sample without any addition of H0475 was prepared according to the identical procedure shown in Example 2a. The final solid content of latex was adjusted to 1.0% (w/w).

Example 3

Deposition Performance of Polystyrene Latex (600 nm) on Fabrics

The deliveries of polystyrene latex (600 nm, with or without H0475) were assessed with LAS and Synperonic A7 as surfactant stock using the constant temperature shaking apparatus (model THZ platform, supplied by Shanghai Jing Hong laboratory instrument Co., Ltd.).

a) Preparation of Stock Solutions

Surfactant stock was prepared by dissolving LAS (5.0 g) and NI (5.0 g) in de-ionised water to a total of 1.0 liter. The surfactant concentration of final solution is 10 g/L (50% LAS, 50% NI). Base buffer stock was prepared by dissolving sodium carbonate (7.546 g) and sodium bicarbonate (2.419 g) in de-ionised water to a total of 1.0 liter. The base buffer concentration is 0.1 M.

b) Bottle Wash Procedure

The constant temperature shaking was utilized to simulate wash procedure for deposition performances assessment. The typical procedure was described as below:

55 mL model wash liquor (1.0 g/L surfactant, 0.01M base buffer) containing 600 ppm polystyrene latex (600 nm) with or without H0475 was prepared in a 60 mL bottle and a 5.0 mL aliquot taken out for absorbance recording at 400 nm. This absorbance value represents 100% particles in the wash solution prior to the bottle wash process.

Two pieces (10×10 cm) of unfluoresced knitted polyester (totally around 2.42 g) or two pieces (10×10 cm) of cotton fabric (totally around 3.16 g) were then placed into the bottle and the bottle sealed. The shaker bath was heated to different temperature for different experiment (25° C. or 40° C.) and the bottle clamped into it and shaken at 125 rpm for 30 minutes to simulate the main wash. The fabrics were then removed and wrung by hand and a 5.0 mL aliquot of the main wash solution taken out for absorbance recording at 400 nm. The amount of adsorbed polystyrene latex on fabric could be determined by turbidity difference before/after main wash stage.

The bottle was then thoroughly rinsed. Wrung fabrics were put back to the bottles and 50 mL of DI water added. The bottle was shaken at 25° C. (or 45° C.) for 10 minutes under 125 rpm to simulate a rinse procedure. The fabrics were then removed and wrung by hand again. A 5.0 mL aliquot of the rinse solution was taken out for absorbance recording at 400 nm. The loss amount of adsorbed polystyrene latex from fabric in rinse 1 stage could be determined according to turbidity. The rinse procedure was repeated once and the loss amount of polystyrene latex from fabric in rinse 2 stage could be determined.

c) Deposition Evaluation Results

The deposition results of polystyrene latex (600 nm, with or without H0475) onto polyester or cotton were illustrated in the following table as mg/g: mg polymer deposition per g fabric (those examples which are embodiments of the invention are shown in bold):

| Sample | Fabric type | Wash temp | Amount adsorbed after main wash (mg/g) | Amount adsorbed after rinse 1 (mg/g) | Amount adsorbed after rinse 2 (mg/g) |
|---|---|---|---|---|---|
| Comparative Example (control) | Polyester | 25° C. | 0 | 0 | 0 |
| **H0475 modified particle** | **Polyester** | **25° C.** | **3.9** | **3.7** | **3.5** |
| Comparative Example (control) | Cotton | 25° C. | 0 | 0 | 0 |
| **H0475 modified particle** | **Cotton** | **25° C.** | **1.4** | **0.7** | **0.6** |
| Comparative Example (control) | Polyester | 40° C. | 0.3 | 0 | — |
| **H0475 modified particle** | **Polyester** | **40° C.** | **4.4** | **4.0** | — |
| Comparative Example (control) | Cotton | 40° C. | 0 | 0 | — |
| **H0475 modified particle** | **Cotton** | **40° C.** | **1.0** | **0.9** | — |

From these results it can be seen that surface attachment of H0475 via EDAC coupling improved particle (600 nm) deposition significantly onto both polyester and cotton.

Example 4

Surface Attachment of HPC onto Latex Particles (4 Micron) Via EDAC Coupling

1-Ethyl-3-(3-dimethylaminopropyl) carbodiimide hydrogen chloride (EDAC) was obtained from Alfa Aesor. All other chemicals were obtained from Sinopharm Chemical Reagent Co., Ltd. 2,2'-azo-bisisobutylnitrile (AIBN) was purified before use by re-crystallization in acetone.

a) Synthesis of Carboxyl Functional Polystyrene Particle (4 Micron)

Carboxyl functional polystyrene particles were synthesized by dispersion copolymerization. 250 mL three-neck flask was charged with 70 mL ethanol and 6.0 mL de-ionised water containing 19.192 g styrene, 1.018 g acrylic acid and 1.536 g poly (N-vinylprrolidiene). A nitrogen blanket and stirring rate of 500 rpm were maintained. This solution was deoxygenated by bubbling with nitrogen for 1.0 h. After thorough deoxygenation, the temperature was increased to 70° C. and 2.420 g AIBN added to this solution. The reaction was kept at 70° C. for 20 hrs. After being cooled to room temperature, the latex was centrifuged at 10000 rpm for 15 minutes and the supernatant decanted off. The latex particles were re-dispersed in 50 mL ethanol, centrifuged at 10000 rpm for 15 minutes and the supernatant decanted off. The latex was then re-dispersed in ethanol and centrifuged again. The supernatant decanted off and the carboxyl functional polystyrene particle collected.

b) Purification of Latex Particles

The carboxyl functional polystyrene particle (4 micron) was purified according to the procedure shown in Example 2b. Finally, the latex was re-dispersed in 750 mL de-ionised water with solids of 1.814% (w/w).

c) Grafting of H0475 onto Latex Particles (4 Micron) Via EDAC Coupling

The purified polystyrene particle (4 micron, 1.814% solids) was grafted with HPC according to the procedure shown in Example 2c. At last, the latex was re-dispersed in de-ionised water to give a final latex dispersion of HPC grafted particles with solids of 1.0% (w/w).

d) Preparation of Comparative Example (Polystyrene Latex without Surface Attached HPC)

A comparative (control) sample without any addition of HPC was prepared according to the identical procedure shown in Example 4a. The final solid content of latex was adjusted to 1.0% (w/w).

Example 5

Deposition Performance of Polystyrene Latex (4 Micron) on Fabrics

The deliveries of polystyrene latex (4 micron, with or without HPC) were assessed with LAS and Synperonic A7 as surfactant stock using the constant temperature shaking apparatus (model THZ platform, supplied by Shanghai Jing Hong laboratory instrument Co., Ltd.).

a) Preparation of Stock Solutions: Same as Example 3a b) Bottle Wash Procedure: Same as Example 3b c) Deposition Evaluation Results The deposition results of polystyrene latex (4 micron, with or without HPC) onto polyester or cotton were illustrated in the following table (embodiments of the invention are shown in bold):

| Sample | Fabric type | Wash temperature | Deposition after Main wash (%) | Deposition after rinse 1 (%) | Deposition after rinse 2 (%) |
|---|---|---|---|---|---|
| Comparative Example (control) | Polyester | 40° C. | 27.2 | 7.3 | 3.5 |
| **H0386 modified particle** | **Polyester** | **40° C.** | **74.2** | **67.2** | **61.2** |
| **H0473 modified particle** | **Polyester** | **40° C.** | **40.7** | **32.7** | **27.4** |
| **H0474 modified particle** | **Polyester** | **40° C.** | **78.5** | **46.5** | **35.3** |
| **H0475 modified particle** | **Polyester** | **40° C.** | **91.1** | **87.3** | **82.8** |
| Comparative Example (control) | Cotton | 40° C. | 20.1 | 8.2 | 3.1 |
| **H0474 modified particle** | **Cotton** | **40° C.** | **74.2** | **49.9** | **36.7** |
| **H0475 modified particle** | **Cotton** | **40° C.** | **88.5** | **76.3** | **63.0** |

These results show that surface attachment of HPC(H0386, H0473, H0474 or H0475) via EDAC coupling significantly improved 4 micron particle deposition onto polyester and cotton. With this particle size the controls show that some small percentage of particles was retained after the rinse, but the improvement of the particles comprising the deposition aid is considerable. With this particle size the improved deposition performance was retained during the rinse.

Example 6

Surface Attachment of HPC onto Perfume Encapsulates (5 μm) Via Melamine Formaldehyde Shell Formation The pre-formed melamine formaldehyde perfume encapsulates were 5 micron in size and obtained from International Flavours and Fragrances (IFF) Limited. The particle solids were 53.8 wt % and perfume solids were 35 wt % respectively. The HPC grade utilised was H0475 from TCI.

The following procedure outlines the synthetic modification to attach HPC to the surface via the formation of additional melamine formaldehyde (MF) shell:

1. Pre-Polymer Preparation

To a 100 ml conical flask was add 19.5 g formalin (37 wt % aqueous formaldehyde) and 44 g water. The pH of the solution was adjusted to 8.9 using 0.7 g of 5 wt % aqueous sodium carbonate. 10 g of melamine and 0.64 g of sodium chloride were added and the mixture stirred for 10 minutes at room temperature. The mixture was heated to 62° C. and stirred until it became clear. This mixture is hereinafter referred to as "pre-polymer (1)".

2. HPC Attachment to Pre-Formed Melamine Formaldehyde Perfume Encapsulates 0.5 g of H0475 HPC was dissolved in 80.4 g deionised water by shaking overnight on an orbital shaker and then transferred to a 250 ml round bottomed flask fitted with overhead stirrer and condenser. 18.2 g of melamine formaldehyde encapsulate slurry (53.8 wt % particle solids) was added and the mixture heated to 75° C. with stirring. 0.9 g of a freshly prepared pre-polymer (1) solution was added and the pH adjusted to 4.1, using 2 g of 10 wt % formic acid aqueous solution. The mixture was then left to stir, at 75° C. for 2 hours. The solution was then cooled and adjusted to pH 7 using 7.5 g of 5 wt % sodium carbonate aqueous solution.

A final dispersion (100 g) consisting of 10 wt % encapsulate solids containing an additional 2 wt % melamine formaldehyde shell and 5 wt % (based on final particle weight) of HPC was obtained.

Example 7

Deposition Performance of HPC Modified Melamine Formaldehyde Perfume Encapsulates on to Polyester Fabric The deliveries of melamine formaldehyde perfume encapsulates (5 μm), with or without HPC, were assessed at 40° C. with LAS and Synperonic A7 as surfactant stock using a constant temperature shaking bath (Model Haake™ SWB25).

For test formulation, dodecylbenzenesulphonic acid sodium salt (LAS) was purchased from Aldrich. Synperonic A7 (NI, Fatty alcohol ethoxylate) was obtained from Uniqema. Sodium carbonate and potassium carbonate were also supplied by Aldrich.

a) Preparation of Stock Solutions: Same as Example 3a b) Bottle Wash Procedure: Same as Example 3b Except that 400 ppm of melamine formaldehyde perfume encapsulates, with and without HPC, were added and only one piece of 20×20 cm polyester fabric was used. Only main wash deposition was assessed, with no additional rinses.

c) Deposition Evaluation Results

The deposition results of melamine formaldehyde perfume encapsulates (5 micron), with or without HPC, onto polyester are illustrated in the following table (the embodiment of the invention is shown in bold):

| Sample | Fabric type | Wash temperature | Deposition after Main wash (%) |
|---|---|---|---|
| Unmodified perfume encapsulate (control) | Polyester | 40° C. | 5.4 |
| **H0475 modified perfume encapsulate** | **Polyester** | **40° C.** | **31.0** |

From these results it can be seen that attachment of HPC (H0475) via melamine formaldehyde shell formation significantly improved perfume encapsulate (5 micron) deposition onto polyester. However, the deposition percentage has fallen significantly as compared to that of the particles where EDAC attachment was used

Example 8

Surface Attachment of HPC onto Perfume Encapsulates (5 μm) Via Melamine Formaldehyde Shell Formation at Reaction Temperature below the Cloud Point of HPC The cloud point of HPC(H0475) is 46° C. The HPC was grafted via melamine formaldehyde shell formation to the perfume encapsulates at a temperature below this (40° C.).

The synthesis was similar to that described in Example 6, except the pre-polymer (1) was prepared at 50° C. and the HPC attachment step (2) was conducted at a reaction temperature of 40° C. for 20 hours.

Example 9

Deposition Performance of HPC Modified Melamine Formaldehyde Perfume Encapsulates Prepared at Reaction Temperature Below the Cloud Point of HPC on to Polyester Fabric The delivery of melamine formaldehyde perfume encapsulates (5 μm) with HPC attachment conducted at a temperature below the cloud point of HPC, were assessed at 40° C. with LAS and Synperonic A7 as surfactant stock using a constant temperature shaking bath (Model Haake SWB25).

For test formulation, dodecylbenzenesulphonic acid sodium salt (LAS) was purchased from Aldrich. Synperonic A7 (NI, Fatty alcohol ethoxylate) was obtained from Uniqema. Sodium carbonate and potassium carbonate were also supplied by Aldrich.

a) Preparation of Stock Solutions: Same as Example 3a b) Bottle Wash Procedure: Same as Example 3b Except only one piece of 20×20 cm polyester fabric was used. Only main wash deposition was assessed, with no additional rinses.

c) Deposition Evaluation Results

The deposition results of melamine formaldehyde perfume encapsulates (5 μm) with HPC attachment conducted at a temperature below the cloud point of HPC, are illustrated in the following table along with the material prepared at 75° C. (Example 6) for comparison (embodiment of the invention is shown in bold):

| Sample | HPC Attachment Reaction Temperature | Fabric type | Deposition after Main wash (%) |
|---|---|---|---|
| H0475 modified perfume encapsulate (Example 6) | 75° C. | Polyester | 31.0 |
| **H0475 modified perfume encapsulate (Example 8)** | **40° C.** | **Polyester** | **81.6** |

From these results it can be seen that surface attachment of HPC(H0475) via melamine formaldehyde shell formation at a temperature below the cloud point of the HPC, significantly improved perfume encapsulate (5 μm) deposition onto polyester, as compared with attachment at a higher temperature.

Example 10

Further Deposition Performance of Particles on Fabrics

1-Ethyl-3-(3-dimethylaminopropyl)carbodiimide hydrogen chloride (EDAC) was obtained from Alfa Aesor and all other chemicals obtained from Sinopharm Chemical Reagent Co., Ltd.

a) Synthesis of Carboxyl Functional Polystyrene Particle (3.6 μm)

Carboxyl-functionalized polystyrene particles were synthesized via dispersion copolymerization. 500 mL three neck flask was charged with 140 mL ethanol and 12.0 mL DI water containing 38.0 g styrene, 1.4 g acrylic acid and 3.0 g poly (N-vinylpyrrolidiene). A nitrogen blanket and stirring rate of 500 rpm were maintained. This solution was deoxygenated by bubbling with nitrogen for 1.0 hr. After thorough deoxygenation, the temperature was increased to 70° C. and 6.0 g AIBN added to this solution. The reaction was kept at 70° C. for 20 hrs. After being cooled to room temperature, the latex was centrifuged at 10000 rpm for 15 minutes and the supernatant decanted off. The latex particles were re-dispersed in 100 mL ethanol, centrifuged at 10000 rpm for 15 minutes and the supernatant decanted off. The latex was then re-dispersed in ethanol and centrifuged again, the supernatant decanted off and the carboxyl functional polyester particle collected.

b) Purification of Latex Particles

The carboxyl functional polyester particle (3.6 μm) was purified via the following procedure.

Step 1: 1.0 mL latex was diluted with 0.5 mL pH 7.01 buffer and centrifuged at 10000 rpm for 15 minutes. The wash in pH 7 buffer was repeated once.

Step 2: The supernatant was decanted off and the latex re-dispersed in DI water. The solution was centrifuged again at 10000 rpm for 15 minutes and the supernatant decanted off. The wash in de-ionised water was also repeated once.

c) Grafting of Polysaccharides onto Latex Particles (3.6 μm) Via EDAC Coupling

Direct chemical coupling with EDAC coupling was used for graft of polysaccharide onto PS particles.

The above purified latex was re-dispersed in 500 mL DI water with solid content of 5.5% (w/w). 25 mL de-ionised water and 0.28 g EDAC was added into 4.57 mL above purified latex (5.5% solid content) and the resulted mixture stirred at 25° C. for 3 hours. Then the latex was centrifuged at 1000 rpm for 10 minutes and purified with pH7 buffer and de-ionised water according to Step 1 and 2 shown in Example 10b. Then the latex was re-dispersed in 20 mL de-ionised water.

Polysaccharide solution (0.9 g/L) was prepared separately and stirred at 25° C. for 3 hours to ensure complete dissolution of any dispersed gel materials. 10 mL EDAC modified PS particle was mixed with 5.6 or 66.7 mL polysaccharide solution as feed ratio of polysaccharide to PS particle 0.05:1 or 0.6:1, respectively. The mixture was then stirred at 45° C. for 24 hours. After that, the latex was centrifuged at 10000 rpm for 15 minutes and purified in pH7 buffer and de-ionised water again according to 1 and 2 shown in Example 10b. At last the latex was re-dispersed in 10 mL de-ionised water to give a final latex dispersion of polysaccharide grafted particles with solids of 1.0% (w/w).

d) Preparation of Comparative Example (Polystyrene Latex without Surface Attached Polysaccharide)

A comparative (control) sample without any addition of polysaccharide was prepared according to the identical procedure shown in Example 10a. The final solid content of latex was adjusted to 1.0% (w/w).

The deliveries of polystyrene latex (3.6 μm, with or without polysaccharides) were assessed with Sodium dodecylbenzenesulphonate (LAS) and Synperonic A7 as surfactant stock using the constant temperature shaking apparatus (model THZ platform, supplied by Shanghai Jing Hong laboratory instrument Co., Ltd.).

e) Preparation of Stock Solutions

Surfactant stock was prepared by dissolving LAS (5.0 g) and Synperonic A7 (5.0 g) in de-ionised water to a total of 1.0 liter. The surfactant concentration of final solution is 10 g/L (50% LAS, 50% Synperonic A7). Base buffer stock was prepared by dissolving sodium carbonate (7.546 g) and sodium bicarbonate (2.419 g) in de-ionised water to a total of 1.0 liter. The base buffer concentration is 0.1 M.

f) Bottle Wash Procedure

The constant temperature shaking apparatus was utilized to simulate wash procedure for deposition performances assessment. The typical procedure was described as below.

55 mL model wash liquor (1.0 g/L surfactant and 0.01M base buffer) containing 600 ppm polystyrene latex (3.6 μm) with or without grafted polysaccharide was prepared in a 120 mL bottle and a 5.0 mL aliquot taken out for absorbance recording at 400 nm. This absorbance value represents 100% particles in the wash solution prior to the bottle wash process.

A piece (20×20 cm) of unfluoresced knitted polyester (around 5.0 g) or three pieces (10×10 cm) of unfluoresced cotton fabric (totally around 4.5 g) were then placed into the bottle and the bottle sealed. The shaker bath was heated to 40° C. and the bottle clamped into it and shaken at 125 rpm for 30 minutes to simulate the main wash. The fabrics were then removed and wrung by hand and a 10.0 mL aliquot of the main wash solution taken out for absorbance recording at 400 nm. The amount of adsorbed polystyrene latex on fabric could be determined by turbidity difference before/after main wash stage.

The bottle was then thoroughly washed. Wrung fabrics were put back to the bottles and 50 mL of DI water added. The bottle was shaken at 40° C. for 10 minutes at 125 rpm to simulate a rinse procedure. The fabric were then removed and wrung by hand again. A 10.0 mL aliquot of the rinse solution was taken out for absorbance recording at 400 nm. The loss amount of absorbed polystyrene latex from fabric in rinse 1 stage could be determined according to turbidity. The rinse procedure was repeated once and the loss amount of polystyrene latex from fabric in rinse 2 stage could be determined.

The deposition results of latex particle model systems onto polyester are illustrated in the following table. Results for compositions according to the present invention are shown in bold. The other examples show how many other polymers do not work.

| Material & Supplier | Visc | Mw | Graft [a] | Dep. wash | Dep. rinse |
|---|---|---|---|---|---|
| **Hydroxypropyl Cellulose (TCI) H0473** | **3-6 (2%, 20° C.)** | **100k** | **31%** | **53%** | **35%** |
| **Hydroxypropyl Cellulose (TCI) H0474** | **6-10 (2%, 20° C.)** | **140k** | **16%** | **72%** | **48%** |
| **Hydroxypropyl Cellulose (TCI) H0386** | **150-400 (2%, 20° C.)** | **620k** | **10%** | **70%** | **54%** |
| **Hydroxypropyl Cellulose (TCI) H0475** | **1000-4000 (2%, 20° C.)** | **910k** | **21%** | **78%** | **60%** |
| **Hydroxypropyl Cellulose (Ashland) HPC-M** | **341 (2%, 25° C.)** | **620k** | **14%** | **53%** | **37%** |
| **Hydroxypropyl Cellulose (Ashland) HPC-MF** | **5300 (2%, 25° C.)** | **850k** | **15%** | **73%** | **63%** |
| **Hydroxypropyl Cellulose (Ashland) HPC-H** | **2510 (2%, 25° C.)** | **910k** | **21%** | **77%** | **67%** |
| Hydroxyethyl Cellulose (TCI) H0242 (Comparative) | 200-300 (2%, 20° C.) | 380k [c] | — | 39% | 19% |
| Hydroxyethyl Cellulose (TCI) H0418 (Comparative) | 4500-6500 (2%, 20° C.) | 557k [c] | — | 57% | 37% |
| Hydroxyethyl Cellulose (TCI) H0392 (Comparative) | 800-1500 (2%, 20° C.) | 1384k [c] | — | 44% | 23% |
| Hydroxyethyl Cellulose (Ashland) 250HR (Comparative) | 1900 (2%, 20° C.) | 1559k [c] | — | 44% | 33% |
| Ethyl cellulose (Ashland) N7 (Comparative) | 7 (5%, 25° C.) [b] | — | — | 26.0% | 7.7% |
| Ethyl cellulose (Ashland) N50 (Comparative) | 50 (5%, 25° C.) [b] | — | — | 32.1% | 10.5% |
| Ethyl cellulose (Ashland) N14 (Comparative) | 14 (5%, 25° C.) [b] | — | — | 32.7% | 12.4% |
| Cellulose Acetate Butyrate (Aldrich) (Comparative) | — | 30k | — | 23% | −3% |
| Hydroxyethyl Ethyl cellulose (TCI) E0131 (Comparative) | — | — | — | 53% | 32% |
| Carboxymethyl cellulose (TCI) C0045 (Comparative) | — | ≈130k DP = 500 | — | 52% | 30% |
| Carboxymethyl cellulose (TCI) C0603 (Comparative) | — | ≈273k DP = 1050 | 27% | 39% | 11% |
| Starch (Alfa Aesar) (comparative) | — | — | 22% | 46% | 31% |
| Carrageenan (TCI) C1804 (comparative) | — | — | — | 33% | 16% |
| Carrageenan (TCI) C1805 (comparative) | — | — | — | 26% | 11% |
| Pectin (TCI) P0024 (comparative) | — | — | — | 37% | 19% |
| Tamarind gum (TCI) T0909 (comparative) | — | — | — | 55% | 36% |
| Xanthan gum (TCI) X0048 (comparative) | — | — | — | 32% | 14% |
| Gum Arabic (Sinopharm Chemical Reagent Co., Ltd) (comparative) | 60-170 (1%, 25° C.) | — | — | 35% | 14% |

[a] Feed ratio of polysaccharide to PS particle is 0.6:1.

[c] Lab analysis results

Example 11

Deposition of Polystyrene Particles on Cotton

The following results were obtained when the latex particles of example 10 were deposited on cotton.

| Material & Supplier | Visc | Mw | Graft [a] | Dep. wash | Dep. rinse |
|---|---|---|---|---|---|
| Original particle (no delivery aid) | — | — | — | 52.4% | 43.9% |
| **Hydroxypropyl Cellulose (Ashland) HPC-HCS** | **2120 (1%, 25° C.)** | **1150k (1149k[b])** | **70%** | **70.0%** | **58.1%** |

[a]: feed ratio of polysaccharide to PS particle is 0.05;
[b] Lab analysis results Example 12

Deposition of HPC Modified Melamine Formaldehyde Perfume Encaps onto Various Fabric Substrates after Washing in a Front Loading Automatic Washing Machine The HPC modified perfume encapsulates prepared at a temperature below the cloud point of HPC, as described in Example 8, were deposited to a mixed fabric load in a front loading automatic washing machine (Miele Honeycomb Care W1714). For comparison the unmodified encapsulates were utilised in a separate identical wash.

a) Wash Details

The wash load composition consisted of cotton sheeting (934 g), terry towelling (787 g), knitted cotton interlock (336 g), polycotton (629 g) and polyester (415 g). The unmodified and HPC modified perfume encapsulates were dosed via a dosing ball at 0.5% (w/w of particles on laundry liquid detergent) that was placed directly into the drum of the machine. The laundry liquid detergent used was Persil Small and Mighty™ (35 ml) that was dosed via the dispensing drawer of the machine. The fabrics were washed on the Express 40° C. wash setting of the machine and after washing were allowed to line dry overnight.

b) Perfume Extraction and Gas Chromatography Quantification

The perfume level on each dried fabric type was determined via extraction into an organic solvent and subsequent quantification of the level via gas chromatography (GC). Isopropanol was used as the solvent as this swells, ruptures the encapsulate and solubilises the perfume components. Analysis was done in quadruplicate for each fabric type and the procedure was as follows. For the woven cotton, polycotton and polyester 10×10 cm square swatches were cut and weighed from the treated fabrics. For the knitted cotton interlock and terry towelling 10×5 cm swatches were used (to allow easy insertion into the vial). Each fabric swatch was placed in a 20 ml headspace vial and 15 ml of isopropanol was added. For comparison control samples for both the unmodified and HPC modified encapsulates were prepared using encapsulate levels representing 100% deposition and directly added to 15 ml isopropanol. The vials were tightly crimped closed and allowed to rotate on a roller mixer (Stuart SRT 9) for 24 hours. The vials were then opened and approximately 1.5 ml of sample was removed via suction using a Pasteur pipette with a strip of paper tissue (Kimtech delicate task wipes) secured around the pipette opening. This was to filter any broken encapsulate residues from the solution. The samples were then added to 2 ml GC vials and sealed. These were added to the GC auto sampler tray and analysed using the following GC conditions:

| | |
|---|---|
| Instrument | Varian 3800 Gas Chromatographer with Flame Ionisation Detector |
| Column | Varian Capillary Column CP-SimDist 5 m 0.53 mm 0.165 μm #CP7522 |
| Injection Volume | 5 microliters |
| Injection Port Temperature | 220° C. |
| Injection Mode | Split (Split Ratio 1.0) |
| Carrier Gas | Helium |
| Column Flow Rate | 0.5 ml/min |
| Temperature Ramp | 50-150° C. at 10° C./min<br>150-250° C. at 20° C./min |
| Detector Temperature | 220° C. |

By comparison of the ratio of the sum of a number of peak areas (retention times=8.7, 10.9, 14.9, 18.1 minutes) for each sample to the equivalent area summation of the 100% deposition control sample, the level of deposited perfume was determined and using the weight of fabric swatch expressed in micrograms per gram of fabric (μg/g). As varying weights of each fabric type were used in the initial wash load, the results were normalised to equal fabric weight. The results are illustrated in the following table:

| | Perfume Deposition (μg/g) | |
|---|---|---|
| Fabric Type | Unmodified perfume encapsulate (control) | H0475 modified perfume encapsulate (Example 8) |
| Woven Cotton | 29.1 | 362.1 |
| Terry Towelling | 28.6 | 486.8 |
| Knitted Cotton Interlock | 59.3 | 1433.7 |
| Polycotton | 13.5 | 347.8 |
| Polyester | 6.6 | 148.4 |

From these results it can be seen that surface attachment of HPC(H0475) via melamine formaldehyde shell formation significantly improved perfume encapsulate (5 μm) deposition, from a front loading washing machine, onto woven cotton, terry towelling, knitted cotton interlock, polycotton and polyester.

The invention claimed is:

1. A benefit agent delivery particle comprising an aminoplast, having at the outer surface of the particle one or more delivery aids which are polysaccharides and include hydroxypropyl cellulose with a molecular weight in excess of 40 kD, wherein the delivery aid is bound to the particle by a covalent bond.

2. A particle according to claim 1 wherein the molar substitution of the hydroxypropyl cellulose aid is in the range from 2.8 to 4.0, more preferably above 3.0, most preferably from 3.2 to 3.8.

3. A particle according to claim 1 which comprises a perfume.

4. A particle according to claim 1 which comprises a core and a shell.

5. A composition comprising:

a) a particle according to claim 1, and, b) an enzyme selected from the group comprising hemicellulase, cellulase, polygalacturonase, xylanase, pectinase, mannanase, pectate lyase, ligninase, pullulanase, pentosanase, arabinosidase, hyaluronidase, chondroitinase, laccase, glycosylhydrolase, and amylases, or mixtures thereof.

6. A laundry treatment composition comprising:

a) a particle according to claim 1, b) at least one anionic or non-ionic surfactant, and, c) an enzyme selected from cellulase, mannanase and mixtures thereof.

7. A laundry treatment composition according to claim 6 wherein the composition is a liquid or gel.

8. A process for the production of benefit agent delivery particles according to claim 1, in which:

a) core-shell particles are formed by emulsion polymerization, and, b) a further polymer layer is formed on the outer surface of the core shell-particles in the presence of hydroxylpropyl cellulose.

* * * * *